US005878601A

United States Patent [19]

Won et al.

[11] Patent Number: 5,878,601

[45] Date of Patent: Mar. 9, 1999

[54] FULLY-AUTOMATED WASHING MACHINE

[75] Inventors: Jong-hwa Won, Yongin; Chang-jun Kim, Seongnam, both of Rep. of Korea

[73] Assignee: Samsung Electronics Co., Ltd., Kyungki-Do, Rep. of Korea

[21] Appl. No.: 924,203

[22] Filed: Sep. 5, 1997

[30] Foreign Application Priority Data

Sep. 13, 1996 [KR] Rep. of Korea ..... 1996-39848

[51] Int. Cl.[6] ..... D06F 39/08

[52] U.S. Cl. ..... 68/23.5; 68/207

[58] Field of Search ..... 68/23.5, 53, 207

[56] References Cited

U.S. PATENT DOCUMENTS 2,449,634 9/1948 Baade ..... 68/207 X
2,513,844 7/1950 Castner et al. ..... 68/53 X

*Primary Examiner*—Philip R. Coe
*Attorney, Agent, or Firm*—Sughrue, Mion, Zinn, Macpeak & Seas, PLLC

[57] ABSTRACT

In a fully-automated washing machine, a rotating cylindrical tub in which laundry is cleaned has an agitating rod installed through the center of the tub. A water-supply pipe is axially formed within the agitating rod by penetrating the same and connected to an external water supplying source. A sprinkler unit installed on top of the agitating rod injects water supplied through the water-supply pipe into the tub. The water is supplied such that it is widely dispersed on the clothes in the tub.

3 Claims, 3 Drawing Sheets

FULLY-AUTOMATED WASHING MACHINE

BACKGROUND OF THE INVENTION

1. Field of the Invention

The present invention relates to a fully-automated washing machine, and more particularly, to a fully-automated washing machine which improves the washing and rinsing performance by using water propelled from an agitating rod in a washing tub.

2. Background

In general, a fully-automated washing machine cleans by performing respective cycles of washing, rinsing and drying according to the state and condition of the laundry.

Referring to FIG. 1, a motor 2 and a decelerator 3 which decelerates the rotating speed of the motor 2 to increase a rotating force thereof are installed in a housing 1 of a conventional fully-automated washing machine. Also, a washing/drying tub 4 is installed above the motor 2 and the decelerator 3. A rotating body 5 is installed in the washing/drying tub 4 and is rotated by the motor 2 and the decelerator 3. An agitating rod 5*a* is installed at the center of the rotating body 5.

In the fully-automated washing machine having the above structure, when laundry (not shown) is put into the washing/drying tub 4, a washing cycle, a rinsing cycle, and a drying cycle are performed in sequence according to a preset program. Here, the washing/drying tub 4 or the rotating body 5, and the agitating rod 5*a* rotate causing friction between the laundry and water, so that washing is performed.

In the meantime, the water supplied through a supply pipe 7 above the washing/drying tub 4 falls on the laundry so that dirt of the laundry can be removed therefrom. Also, the water in the washing/drying tub 4 is discharged through a discharge pipe 8.

However, since the area into which the water from the supply pipe 7 falls onto the laundry is limited, the efficiency of washing by the falling water is not high.

SUMMARY OF THE INVENTION

To overcome the above problem, it is an objective of the present invention to provide a fully-automated washing machine having a high washing efficiency by enlarging the area into which water falls on the laundry.

Accordingly, to achieve the above objective, there is provided a fully-automated washing machine including: a rotating cylindrical tub in which laundry is cleaned, having an agitating rod through the center thereof; a water-supply pipe axially formed within said agitating rod and connected to an external water supply source; and a sprinkler unit installed at the top of said agitating rod which injects water supplied through said water-supply pipe to the laundry in said rotating cylindrical tub.

It is preferable in the present invention that a plurality of sprinkler holes be radially formed in the sprinkler unit which is connected to the water-supply pipe.

It is also preferable in the present that the sprinkler holes be formed at different angle such that the water injected from each of the sprinkler holes can reach a different area of the tub.

BRIEF DESCRIPTION OF THE DRAWINGS

The above objective and advantage of the present invention will become more apparent by describing in detail a preferred embodiment thereof with reference to the attached drawings in which.

DETAILED DESCRIPTION OF THE INVENTION

Figure 1:
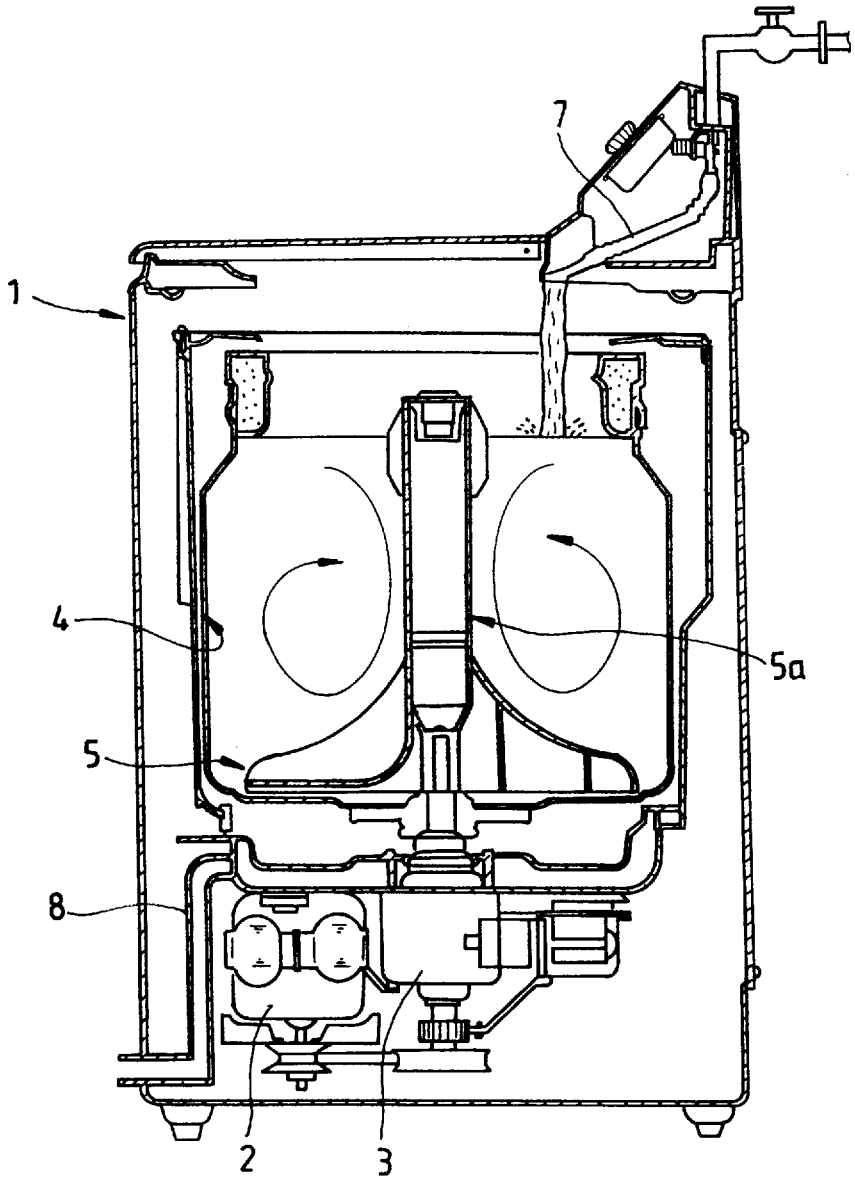
FIG. 1 (PRIOR ART)
FIG. 1 is a sectional view illustrating a conventional fully-automated washing machine.
Figure 2:
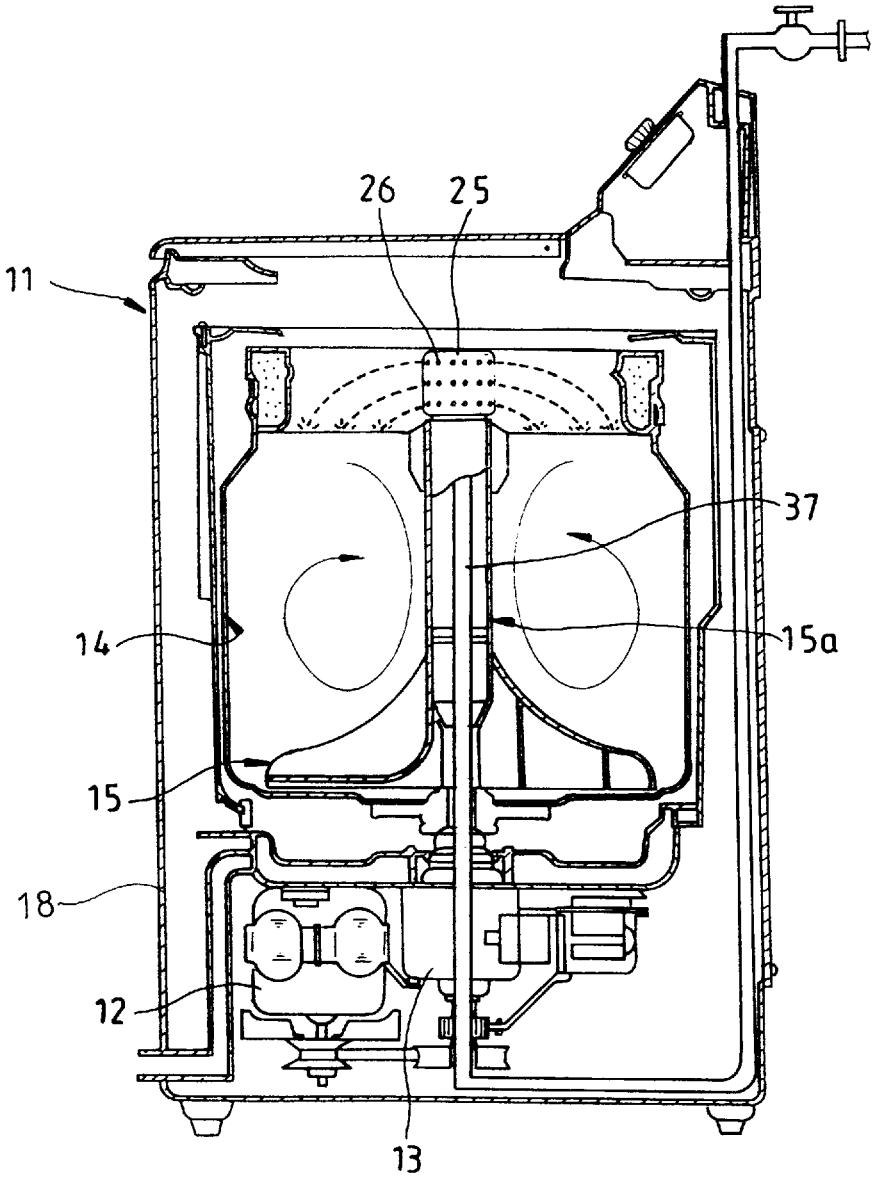
FIG. 2 is a sectional view illustrating a fully-automated washing machine according to the present invention.

Referring to FIG. 2, a fully-automated washing machine according to an embodiment of the present invention includes a housing 11, a motor 12 installed in the housing 11, a decelerator 13 which increases a rotating force of the motor 12 by decelerating a rotating speed thereof, and a washing/drying tub 14 installed above the motor 12 and the decelerator 13. A rotating body 15 which is rotated by the motor 12 and the decelerator 13 is installed in the washing/drying tub 14, and an agitating rod 15*a* is fixed to the rotating body 15 at the center portion thereof.

According to the characteristic of the present invention, a water-supply pipe 37 is formed within the agitating rod 15*a* by penetrating through the same. The water-supply pipe 37 is connected to an external water supply source. A sprinkler unit 25 which injects water into the tub 14 is installed above the agitating rod 15*a* and connected to the water-supply pipe 37.

Figure 3:
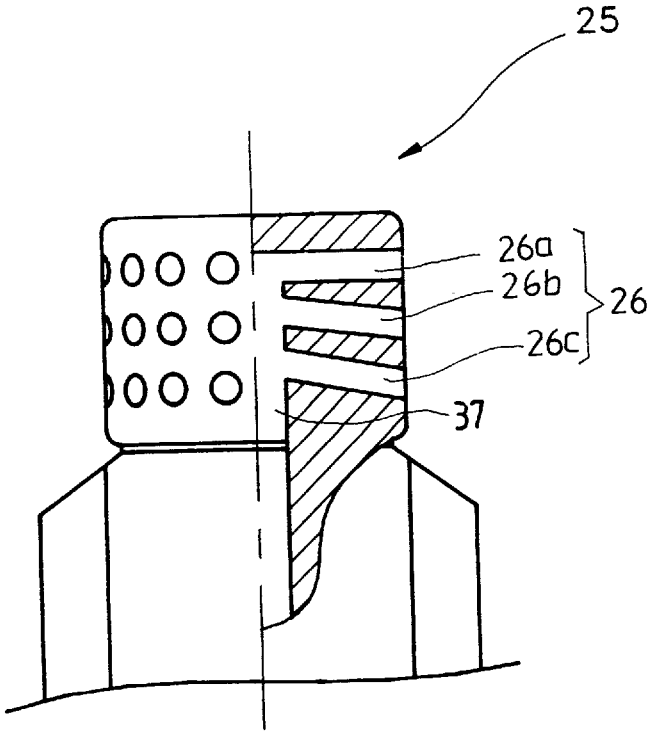
FIG. 3 is a partially cut away sectional view showing the injection unit shown in FIG. 2.

As shown in FIG. 3, the sprinkler unit 25 has a plurality of sprinkler holes 26 for injecting water into the tub 14 which are formed radially therein. Preferably, the sprinkler hole 26 are formed symmetrically with respect to an axle of the agitating rod 15*a*. A formation angle of the sprinkler hole 26 can be properly adjusted according to the sprinkler distance of water, as will be described later. As shown in FIG. 3, it is preferable that the formation angle of the upper sprinkler hole 26 located at 30 the upper portion of the sprinkler unit 25 with respect to the axle of the agitating rod 15*a* be greater than that of the sprinkler hole 26 located at the lower portion of the sprinkler unit 25. The washing/drying tub 14 is connected to a discharge pipe 18 for discharging water.

The operation of the fully-automated washing machine structured above will now be described with reference to the accompanying drawings.

When laundry (not shown) is put into the washing/drying tub 14, a washing cycle, a rinsing cycle and a drying cycle are sequentially performed according to a preset program. That is, the laundry is cleansed due to friction between the laundry and water as the washing/drying tub 14 or the rotating body 15, and the agitating rod 15*a* rotate.

In the respective cycles, the water supplied through the water-supply pipe 37 is injected to the top of the rotating laundry through each sprinkler holes 26. At this time, the water injected from a sprinkler hole 26*a*, which is formed relatively horizontally, reaches an outer portion of the tub 14, the water injected from sprinkler holes 26*b* reaches a mid portion of the tub 14 and the water injected from the sprinkler holes 26*c* reaches an inner portion of the tub 14. Accordingly, water can be uniformly injected to the entire upper area in the washing/drying tub 14. The water injected from the sprinkler holes 26 collide with the laundry and accordingly dirt of the laundry separates from the laundry due to the impact of the water.

Here, since the water diverges to the entire upper area of the laundry as described above, the efficiency of washing from the water becomes high. The dirty water after washing is discharged through the discharge pipe 18.

As described above, in the fully-automated washing machine according to the present invention, since water is injected to the entire upper area of the laundry, the efficiency of washing of the laundry is improved compared to the conventional technology by which the water is injected to a limited area of the laundry.

What is claimed is:

1. A fully-automated washing machine, comprising:

a rotating cylindrical tub for receiving laundry to be cleaned and having an agitating rod through the center thereof;

a water-supply pipe axially formed within said agitating rod and connected to an external water supply source; and a sprinkler unit installed at the top of said agitating rod which injects water supplied through said water-supply pipe to the laundry in said rotating cylindrical tub, wherein said sprinkler unit has at least two series of sprinkler holes extending generally radially outwardly, said holes being formed at different angles such that each series of said sprinkler holes is progressively angled further outward with respect to said agitating rod.

2. A fully-automated washing machine as claimed in claim 1, wherein said sprinkler holes are progressively angled further outward from the bottom holes to the top holes.

3. A fully-automated washing machine as claimed in claim 1, wherein said sprinkler holes are symmetrically formed with respect to a longitudinal axis of said agitating rod.

* * * * *